US005609177A

United States Patent [19]

Iver

[11] Patent Number: 5,609,177

[45] Date of Patent: Mar. 11, 1997

[54] PORTABLE CABANA

[76] Inventor: Morton Iver, 535 Waterside Dr., Lantana, Fla. 33462

[21] Appl. No.: 634,296

[22] Filed: Apr. 18, 1996

[51] Int. Cl.[6] ..... E04H 15/38

[52] U.S. Cl. ..... 135/130; 135/133; 135/138

[58] Field of Search ..... 135/900, 901, 135/902, 128, 133, 136, 137, 138, 130

[56] References Cited

U.S. PATENT DOCUMENTS

| | | | |
|---|---|---|---|
| 2,543,597 | 2/1951 | Peery | 135/133 X |
| 2,960,993 | 11/1960 | Holmstrom | 135/130 |
| 3,082,780 | 3/1963 | Macy | 135/130 |
| 3,323,530 | 6/1967 | Smith | 135/901 X |
| 3,913,598 | 10/1975 | Glutting, Jr. et al. | 135/901 X |
| 4,239,247 | 12/1980 | Hinz | 135/901 X |
| 4,612,948 | 9/1986 | Simpson | 135/900 X |

FOREIGN PATENT DOCUMENTS

| | | | |
|---|---|---|---|
| 0849296 | 8/1970 | Canada | 135/130 |
| 1441229 | 4/1966 | France | 135/137 |

*Primary Examiner*—Lanna Mai
*Attorney, Agent, or Firm*—Alvin S. Blum

[57] ABSTRACT

A knock down beach cabana is compact enough to be carried by one person; stored in a car trunk and readily assembled and disassembled. Long tubes join together to form three U shaped frame elements that are held together by two rigid bases. A center frame element is held perpendicular to the base and two end frame elements extend upward at an angle to the center frame element. A top cover panel and two side cover panels attach to the frame. One end panel closes off one end of the cabana to form a floor in one position or for privacy in another position.

12 Claims, 2 Drawing Sheets

PORTABLE CABANA

FIELD OF THE INVENTION

This invention relates to portable shelters, and more particularly to a knock down beach cabana providing adjustably variable sheltering panels.

BACKGROUND OF THE INVENTION

When people are at the beach, they may need shelter from the sun or the wind. They may prefer to lie on a surface other than sand. They may wish to enjoy the beach when the sun is shining but the air is cold.

Various rigid and flexible, fixed and portable cabanas have been provided in the prior art to satisfy those requirements. Even the simplest are so large, bulky and awkward that the usual beachgoer cannot carry one to the beach of choice. If there is no commercial cabana rental agency at the chosen beach, the beachgoer must do without or select another beach. Even the commercial cabana rental firms find the cabanas of the prior art bulky to transport and store. In many areas, the beach season is short, and it is uneconomic to provide large storage capacity for a long period when the product is used for only a short period.

The cabanas of the prior art have fixed shelter panels. If the sun or wind shifts the entire structure must be rotated, and there are no provisions for altering the size and location of various sheltering panels to accommodate various changing requirements as sun and wind conditions change.

It would be desirable to provide a beach cabana that knocks down into a small volume for transport and storage and that is readily adaptable to various changing conditions.

SUMMARY OF THE INVENTION

It is, accordingly, an object of the invention to provide a knock down cabana structure that is readily assembled and dismantled, that stores in a small volume and that is readily adapted to the various conditions encountered at the beach.

The cabana of the invention comprises a knock down pipe frame and a plurality of foldable, pliable covering panels. The pipe frame comprises straight pipe sections Joined by connectors to form three U shaped frame elements. A pair of support blocks, one on each side of the cabana, has holes to receive the free ends of the frames, holding the center frame vertical and the outer frames fanning outward. Two pipes join the middle of the center frame to the middle of each outer frame, thereby providing a rigid frame assembly structure.

A fabric top panel with hook-and-loop connectors covers the top of the cabana formed by the three center portions of the U shaped frames. A front panel is removably attachable to one of the outer frames for additional shelter as required. The cabana is easily tipped onto the front panel so that the front panel becomes a floor. When tipped the other way, privacy is provided for changing clothes when panels are attached to the sides. Troughs may be formed in the edges of the side panels to be filled with sand for added stability if desired.

These and other objects, features and advantages of the invention will become more apparent when the detailed description is studied in conjunction with the drawings, in which like reference characters refer to like elements in the various figures.

DETAILED DESCRIPTION OF THE PREFERRED EMBODIMENT

Figure 5:
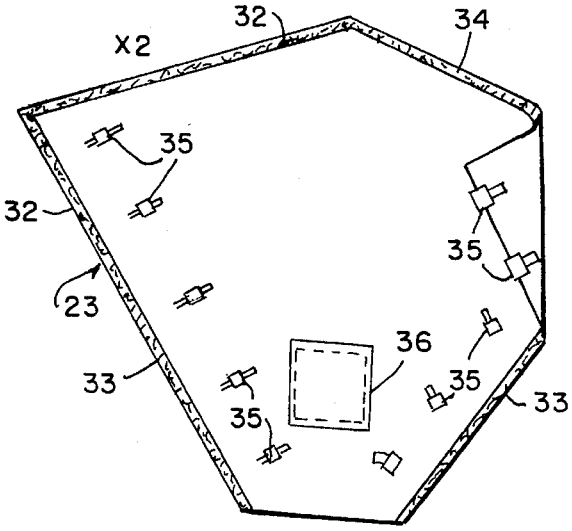
FIG. 5 is a perspective view of one of the side cover panels.
Figure 6:
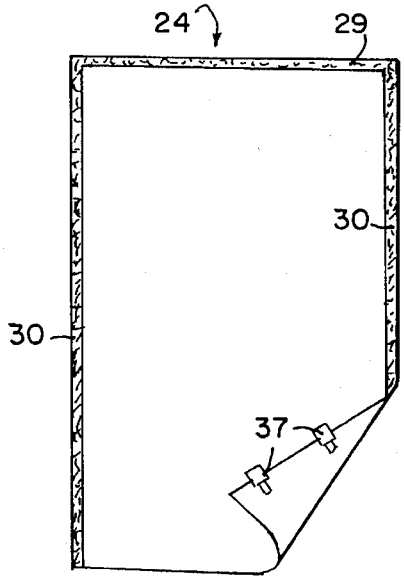
FIG. 6 is a perspective view of the end cover panel.
Figure 3:
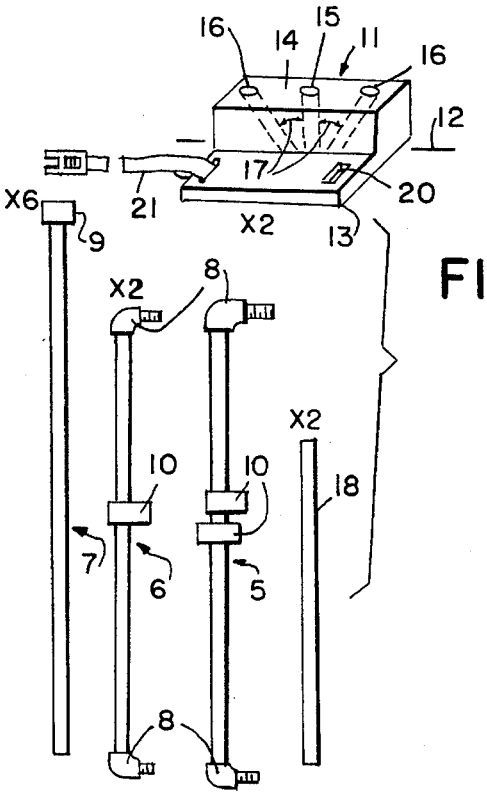
FIG. 3 is a perspective view of the unassembled frame kit.
Figure 4:
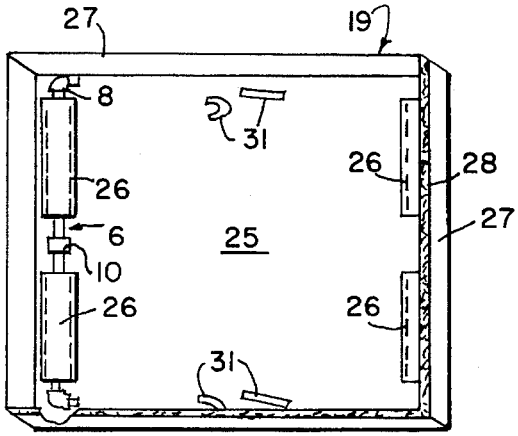
FIG. 4 is a perspective view of the top cover panel.

Referring now first to FIGS. 2–6, the cabana of the invention comprises a readily assembled and disassembled or knock down kit of parts including the frame kit of FIG. 3 including two rigid bases 11, six elongate end tubes 7 with straight female threaded connectors 9. Connectors and tubing may be of any suitable rigid material. Conventional PVC connectors and tubing have been found to be satisfactory. Two center tubes 6 for the end frame elements have rigid threaded male elbows 8 at each end and an unthreaded female T connector 10 in the center. Each center tube 6 is joined to two end tubes 7 to form a U shaped end frame element 4. A center tube 5 with two T connectors is connected to two end tubes 7 to form a U shaped center frame element 3. These frame elements are inserted into the two bases 11, the free ends of the center frame element fitting into the center passages 15 in the base that extend orthogonal to the long axis 12 of the bottom surface 13 of the base that is to be supported on the beach sand or other supporting surface. Two side passages 16 extend downward from the upper surface 14 of base 11 at an angle 17 of between fifteen and fifty degrees from the center passage to receive therein the end frames. Elongate tubular struts 18 fit into the unthreaded connectors 10 to join the three frame elements together to form substantially triangular structures of enhanced rigidity. The bases 11 are of wood and provide rigidity and weight to stabilize the assembled frame. FIGS. 4–6 show the underside of the top panel 19, the end panel 24 and one of the side panels 23 that removably cover the assembled frame.

Figure 1:
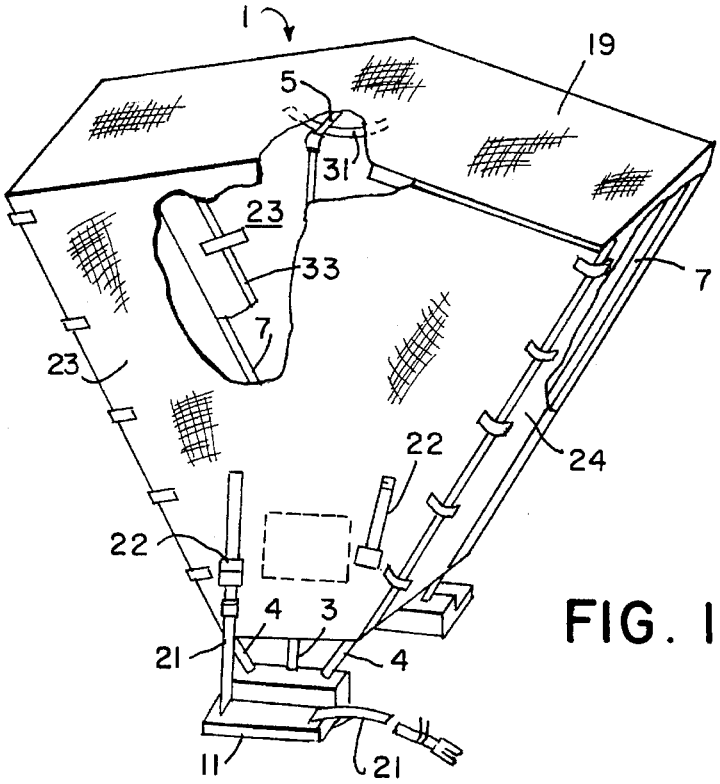
FIG. 1 is a perspective view of the cabana with a portion broken away.
Figure 2:
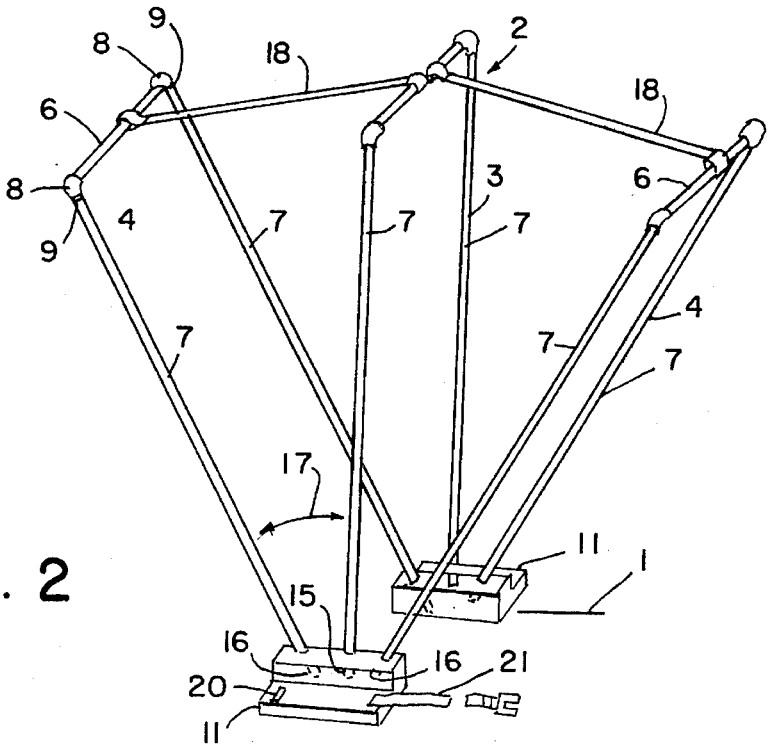
FIG. 2 is a perspective view of the assembled frame without top panel.

The top panel 19 of FIG. 4 has, on its underside 25, open ended sewn sleeves 26 adapted to receive the center tubes 6 of the end frame elements before the end tubes 7 are connected to form the end frame elements. The top panel 19 has a perimeter 27 extending orthogonal to the broad face of the panel. The perimeter being provided on its outerside with a strip of hook and loop connection material 28 for joining to the side panels and an end panel after the frame is assembled. Connecting straps 31 may be provided to engage the assembled center frame element. Each side panel 23 has a perimetral strip of hook and loop fastener 32. The top edge 34 is adapted to join the corresponding fastener strip 28 on the outside edge of the top panel. The two side edges 33 are adapted to wrap around the end tubes 7 of the end frame elements as illustrated in FIG. 1. A plurality of snap together straps 35 with length adjusting buckles of the type well known in the luggage art secure the side edges about the tubes. The secured edge 33 forms a trough which may be filled with sand when that end is laid down on the sand for stability in a high wind. A pocket 36 may be sewn on the inner surface for storage. The completed cabana with top and side panels may be used with the top upright and the bottom surface of the bases on the sand. Connecting straps 21 passed through slots 20 in the bases may be connected to flexible strap connections 22 sewn onto the outer surface of the side panel as best seen in FIG. 1. For privacy or to block the sun or wind, the end panel 24 of FIG. 6 may be attached by joining the upper hook and loop fastener 29 to the corresponding fastener 28 on the top panel and the side hook and loop fastener 30 to the corresponding fastener 32 on the side panels at their side edges 33. Strap fasteners 37 on the end panel may be connected to the fasteners 35 on the side panels as well.

The completed cabana may be turned with the end panel down for a sand free floor at the beach. With the open end on the sand and the end panel uppermost, the cabana offers privacy and shelter such as for changing clothes.

The panels are made from a sturdy woven fabric that is sewn. The panels may alternatively be made of a variety of other flexible sheet materials such as non woven fabric and film and may be t,eat sealed or cemented as desired.

The knocked down frame may be carried and stored in a long narrow bag. The folded panels may be carried and stored in a compact bag. The cabana can be stored in the trunk of a car and carried to the beach and assembled by one person in a short time.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. A readily assembled and disassembled beach cabana comprising:

(A) a frame comprising three substantially U shaped frame elements, a center frame element and two end frame elements, each frame element having a long center tube and two parallel long end tubes removably joined together by rigid connectors; two rigid bases, each base having a bottom surface with a long axis, the bottom surface adapted for supporting the assembled cabana on a supporting surface, and having an upper surface with three passages for receiving therein the tubular ends of the three frame elements, a central passage extending into the base orthogonally to the long axis, removably receiving the end tube of the center frame element, and two side passages extending into the base at an angle of between fifteen and fifty degrees to the central passage, removably receiving the tubular ends of the end frame elements; a first elongate tubular strut removably joining the center tube of the center frame element to the center tube of one of the end frame elements; and a second elongate tubular strut removably joining the center tube of the center frame element to the center tube of the other of the end frame elements;

(B) a flexible street top panel removably covering the center tubes of the three frame elements and extending over the rigid connectors, the top panel having a broad underside, a broad outerside and a perimeter, the underside provided with means for removably attaching to the center tubes of the two end frame elements, the perimeter of the outerside being provided with joining means for removably joining to other flexible sheet panels;

(C) two flexible sheet side panels, each side panel having a wide top edge removably joined by said joining means to the top panel and two side edges extending downward from the top edge and toward one another to removably cover the end tubes of the three frame elements, each side edge provided with means for removably attaching to the end tubes of the two end frame elements; and (D) a flexible sheet end panel having a substantially rectangular shape and a top margin removably joined by said joining means to the top panel and two side margins, removably attached to the side edges of the side panels.

2. The cabana according to claim 1 further comprising removable, flexible connections between the side edges of a side panel and a base.

3. The cabana according to claim 2, in which said joining means comprises hook and loop fasteners.

4. The cabana according to claim 3, in which the flexible sheet comprises woven fabric.

5. The cabana according to claim 3, in which the flexible sheet comprises non-woven fabric.

6. The cabana according to claim 3, in which the flexible sheet comprises film.

7. The cabana according to claim 1, in which said joining means comprises hook and loop fasteners.

8. The cabana according to claim 7, in which the flexible sheet comprises woven fabric.

9. The cabana according to claim 7, in which the flexible sheet comprises non-woven fabric.

10. The cabana according to claim 7, in which the flexible sheet comprises film.

11. The cabana according to claim 1, in which the means for removably attaching the top panel to the center tubes of the end frame elements are open ended sleeves affixed to the underside of the top panel.

12. The cabana according to claim 1, in which the long edges of the side panels are adapted to form sand receiving troughs for stability when the cabana is laid on the sand with one of the end frame elements on the sand.

* * * * *